United States Patent [19]

Hart

[11] 3,993,409

[45] Nov. 23, 1976

[54] COLORING PEN ASSEMBLY

[76] Inventor: Una L. Hart, 1750 Summit Ave., St. Paul, Minn. 55105

[22] Filed: Sept. 5, 1975

[21] Appl. No.: 610,691

Related U.S. Application Data

[63] Continuation-in-part of Ser. No. 471,437, May 20, 1974, abandoned.

[52] U.S. Cl. ..... 401/199; 401/57; 401/201

[51] Int. Cl.[2] ..... B43K 5/00

[58] Field of Search ..... 401/198, 199, 201, 202, 401/133, 134, 57

[56] References Cited

UNITED STATES PATENTS

| | | | |
|---|---|---|---|
| 3,457,014 | 7/1969 | Ward | 401/201 X |
| 3,459,483 | 8/1969 | Brastad | 401/201 X |
| 3,481,677 | 12/1969 | Abrahamson | 401/198 |
| 3,520,629 | 7/1970 | Otsuka | 401/199 |
| 3,544,229 | 12/1970 | Aoki et al. | 401/199 |

*Primary Examiner*—Lawrence Charles
*Attorney, Agent, or Firm*—Harold J. Kinney

[57] ABSTRACT

A coloring pen assembly comprising a tubular barrel open at one end and holding at the other end a porous nib having a marking tip, an extended portion lying within the barrel, and saturated with soluble coloring matter. For activation, a porous plug fitting loosely within the barrel and snugly around the extended portion of the nib is saturated with a liquid solvent, e.g. water, and is inserted through the open end of the barrel and pressed into place.

6 Claims, 5 Drawing Figures

COLORING PEN ASSEMBLY

This application is a continuation-in-part of my copending application Ser. No. 471,437 filed May 20, 1974, now abandoned.

This invention relates to an improvement in marking or coloring pens and deals particularly with a pen capable of marking or coloring surfaces with an FDA certified color or combination of colors which may be washed from a washable surface. The color or combination of colors is incorporated into the nib and the pen is sold in the dry state. The pen can be safely and easily activated by a child by simply adding water to form a writing fluid or ink. This is accomplished by inserting into the open end of the barrel, so as to envelop the nib, a water saturated porous plug having approximately the same length as the portion of the nib contained within the barrel. If the pen dries out prematurely, it can easily be made usable again by the addition of a small amount of water. The pen will not cause injury to the child in the event the color is taken internally.

BACKGROUND OF THE INVENTION

Various types of marking pens have been produced which are designed to apply ink or other liquid material to a receptive surface, e.g. paper.

The pen assembly of this invention is completely stable during prolonged periods of storage, yet contains a full complement of coloring material, whereas ordinary porous nibbed pens of the prior art are subject to leakage, drying out, clogging and similar difficulties in storage.

My pen may be made operable by the introduction of solvent (e.g. water) only, whereas many prior art porous nibbed pens (and those on sale that I have encountered) have commonly contained or required the addition of liquid ink.

In the preferred embodiments of my pen, water (or solvent) is introduced in controlled amounts by means of a self-measuring porous plug, so that the desired tint is conveniently and uniformly attainable. This accomplishment is not available in prior art porous nibbed pens with which I am familiar. My pen assembly makes it possible to obtain sufficient solution of the dye and diffusion of the ink throughout the assembly of the porous plug or body and the nib, so that the pen can be used within a short time, e.g. 2 to 10 minutes, after insertion of the wet porous body or plug into the barrel of my pen. U.S. Pat. No. 3,003,182 provides a porous reservoir body filled with liquid ink and from which the ink flows by capillarity to an easily removable and replaceable porous felt writing tip or nib. Ink is introduced by removing the reservoir body and dipping it in liquid ink, with attendant likelihood of soiling the fingers. Interchangeability of nibs is achieved in part by minimal contact between nib and reservoir, thereby impeding the flow of ink to the writing tip.

In the device of U.S. Pat. No. 3,481,677 the nib and reservoir are combined in a single expandable porous body which may contain a soluble dye. Dipping the writing tip in an appropriate aqueous dye solution results in expansion of the porous body so that a pointed writing tip cannot be maintained.

In U.S. Pat. No. 3,544,229 there is described a marking pen having an ink-conducting point or nib extending into an ink-containing chamber wherein the liquid ink is capillarily retained by a loose mass of threads formed of loosely twisted fibers. The construction requires that the ink be added after the fibrous mass is in place, an operation requiring considerable skill.

SUMMARY OF THE INVENTION

The present device comprises a tubular barrel in one end of which is secured a porous nib or writing tip having capillary passages extending therethrough and which is impregnated with soluble coloring matter. The nib extends into the barrel a substantial distance. Removable caps are provided which serve to close the open end of the barrel and to fit over the nib end. These caps may be of identical design so that two or more pens may be connected in tandem as will be further described.

For each pen there is also provided a porous plug or reservoir which, after saturation with a suitable solvent in specified amount, is inserted through the open end of the barrel and intimately around the inwardly extending nib, thereby activating the pen for use. The coloring matter from the nib dissolves in the liquid to form the marking fluid which may thereafter be applied from the exposed end of the nib to any desired receptive surface. In a preferred form the coloring matter is a certified food color or mixture and the solvent or activating liquid is water, thereby assuring both safety and cleanliness in the activation and use of the pen, particularly by small children.

DETAILED DESCRIPTION

Figure 1:
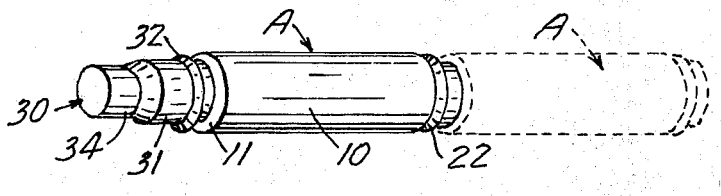
FIG. 1 is a perspective view of a coloring pen showing, in dotted outline, the manner in which two adjoining similar pens may interfit together.
Figure 2:
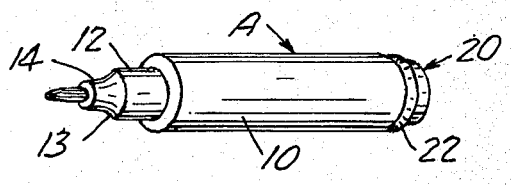
FIG. 2 is a perspective view similar to FIG. 1 but showing the protective cap removed.
Figure 3:
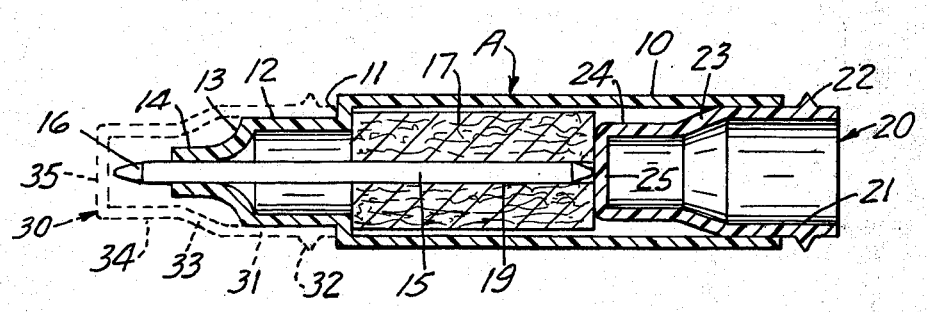
FIG. 3 is a longitudinal section view through the coloring pen in readiness for use.

A preferred form of pen is indicated in FIGS. 1 – 3 by the letter A. As is best indicated in FIG. 3 of the drawings, the pen includes an elongate tubular body 10 which is connected at one end by a shoulder 11 to a somewhat smaller diameter portion 12. The intermediate smaller diameter portion 12 is connected by a rounded area of connection 13 to a smaller diameter end portion 14.

Th nib 15 may be formed of wood, synthetic nylon or vinyl fibers or other such material which when grouped together form a flexible dimensionally stable shaft, which is somewhat porous to water, and which is provided with longitudinal channels extending from one end to the other thereof. The nib 15 extends through the small diameter portion 14 of the barrel A and is provided with a rounded or pointed end 16.

A tubular porous plug 17 is provided which fits loosely within the barrel 10 and closely envelops the nib 15. A plug type cap 20 fits snugly within the otherwise open end of the barrel 10. The plug cap 20 is provided with a tubular portion 21 which fits frictionally within the end of the barrel 10, and is provided with a flange 22 on its exterior surface by means of which the cap may be removed. The tubular portion 21 is connected by a tapered section 23 to a smaller diameter tubular portion 24 having a closed end 25 which is designed to retain the wetted porous plug 17 in place, and which also forms an abutment against which the nib 15 may engage. As is indicated in phantom in FIG. 3 of the drawings, a cap 30 of a similar pen may frictionally fit over the small diameter portion 12 of the barrel so that a series of pens may be secured in axial alignment if it is so desired. Some means of identifying the color of the dye impregnating the nib 15 is usually provided on the exterior of the pen, as the pens are otherwise all quite similar in shape and appearance. For example, the barrel may be made of a molded thermoplastic material colored to represent the color of the dye. The extent to which the nib projects from the pen barrel is somewhat a matter of choice. However, the exposed portion of the nib has a tendency to dry out when the pen is not being used, and accordingly the nib usually projects only a short distance from the end 14 so that the rounded or pointed extremity is readily visible to the child as the pen is used.

A cap 30 is normally used to close the end of the pen from which the nib projects when the pen is not in use. The cap 30 is, or may be, substantially identical with the cap 20 which has been previously described. The cap 30 includes a cylindrical portion 31 which frictionally fits the smaller diameter portion 12 of the barrel, this portion of the cap being provided with a flange 32 similar to the flange 22 previously described. The cylindrical portion 31 is connected to a tapered portion 33 which is similar to the previously described portion 23 and connects the larger diameter portion of the cap to a reduced diameter portion 34 which corresponds to the cap portion 24. The end closure 35 of the cap 30 which encloses the rounded end 16 of the nib 15 also corresponds to the closed end 25 of the plug 20. While it is not necessary to make the caps 20 and 30 of identical form and shape, this is of advantage from a production standpoint as it permits the caps 20 and 30 to be interchangeable in use.

The pen may be sold partially assembled with the nib in place. Because the pen is dry, it is necessary to add water in order to start the pen in operation. This is accomplished by immersing the porous plug in water in order to saturate it with water. The wet plug is inserted into the open end of the barrel and gently pushed onto the colored nib, using the cap 20 to complete the process. After a few minutes the rounded or pointed end 16 may be used for the coloring process. If the pen dries out prematurely, it may be rendered usable again by removing cap 20, adding a small amount of water and reinserting cap 20.

The pen may alternatively be sold assembled, in which case water is added by removing cap 20, adding sufficient water to saturate the porous plug and reinserting cap 20 to prevent the porous plug from falling out and to prevent the premature drying out of the pen. However, the latter procedure does not provide for automatic measurement of water and pre-assembly is therefore not preferred.

In some cases, the process of impregnating the nib with water can be somewhat speeded up by dipping the exposed end of the nib into water. However, in view of the fact that a uniform color is desired, it is usually preferable to fill the pen in the manner described and to wait the short time necessary to activate the pen.

Figure 4:
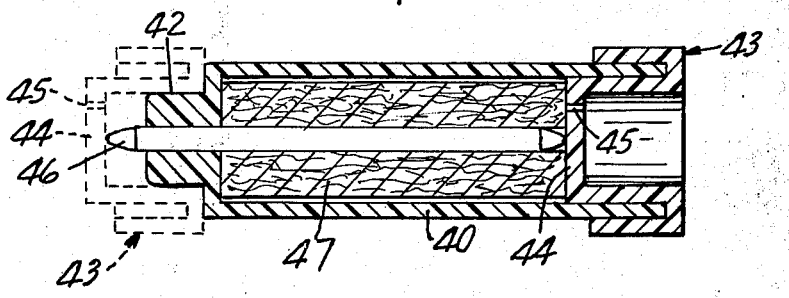
FIG. 4 is a longitudinal section view showing an alternative form of coloring pen.

The device of FIG. 4 similarly comprises a tubular barrel 40, open at one end and constricted at the other end about a porous nib 46. A porous plug 47 fits loosely within the barrel and snugly about the full length of the inwardly extended portion of the nib 46 and during activation is pressed into place with a cap 43, the end wall 44 of the cap contacting the ends of both plug and nib as shown. A capillary orifice 45 in the end wall is provided for equalization of air pressure between the inside of the pen and the atmosphere. As shown in phantom, a second cap 43 may be placed over the projecting tip of the pen when desired; or a series of pens may be held together in tandem as previously described.

Figure 5:
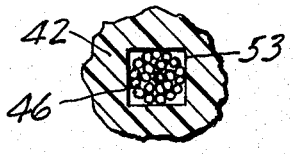
FIG. 5 is an enlarged, detail view showing another and preferred structure of nib and retaining barrel-end.

FIG. 5 illustrates a typical structure for retaining the nib in the constricted barrel-end. The nib 46, here illustrated as comprised of parallel threads or filaments bundled together in circular cross-section is forced through a square orifice 53 in the end wall 42 of the barrel 40 of FIG. 4, providing a snug fit but with narrow spaces at or along the corners of the orifice. The orifice 45 (FIG. 4) may be omitted, so that the cap then provides a fully effective vapor-proof seal when placed over the writing end of the pen as shown in phantom.

The nib 15 (FIG. 3) may be considered to comprise a somewhat flexible member. By the term "flexible" it is meant that the nib, although relatively rigid, may be slightly bent under writing pressure but normally returns to its original shape after being used. The nib 15 is also preferably formed of a material which is nonreactive with the harmless coloring dye which is used and from which the coloring material can rapidly diffuse into the porous plug.

The color may be incorporated into the nib as a dry powder during the production of the nib but the nib is preferably impregnated with a 4–20% solution of a certified food color or a mixture of colors and thereafter carefully dried. A typical porous nib will thereby take up from about 0.02 to about 0.11 gram of dye per gram weight of nib.

It is possible to use additives to stabilize quickly the intensity of the color and to speed up the rate of activation. For example, a food color known to the trade as FDA Certified Food Color Red No. 3 (i.e. FD & C Red No. 3) is often used to produce a pink color. In concentrated solution, however, the color is bluish red. In order to obtain a pink color rather than a red color when the pen is first activated, it is necessary to slow down the rate of dissolution of the color until it diffuses from the nib into the water reservoir. It is possible to slow down the rate of dissolution of the color until it issues as a constant pink color, e.g. by incorporating into the nib a simple salt such as sodium chloride in an amount equal to 10–30% of the weight of the color present. A chemical of this type obviously is not harmful to the child even if taken internally and acts to produce a pink color instead of an initially reddish color which gradually turns pink as the pen is used.

Food grade surfactants may also be added, e.g. in amounts of one to twenty percent of the weight of the dye, to facilitate the complete wetting of the nib so that the color or dye diffuses rapidly throughout the porous plug. However, care must be taken to limit the amount of surfactant so that it is not sufficiently great to cause the colored water to leak from the nib.

The nib must have maximal contact with the water reservoir for rapid diffusion of the color and subsequent constant shade of color during use. The length of the porous plug should be approximately equal to the length of the section of the nib in the widest section of the barrel. The nib will then be enveloped by the plug. For example, for a marking pen a convenient minimum size of nib is 2.0 mm × 25 mm, and 8 mm × 20 mm is a satisfactory size of porous plug for this nib.

The porous plug employed as the liquid reservoir is preferably composed of natural or synthetic fibers held together by suitable binders in an elongated shape having a diameter slightly smaller than the inside diameter of the pen barrel, and a length at least approximately equal to the portion of the nib contained within the barrel. A preformed plug of cotton fibers is useful. Improved results have been obtained with plugs of bonded longitudinally aligned cellulose acetate fibers. The latter form is particularly desirable in permitting easy penetration of the nib even in the absence of a preformed axial opening in the plug.

The liquid retention capacity of the porous plug determines the intensity of color. Using a plug of low capacity will provide a darker color, a higher capacity a lighter color, with the same amount of coloring material in the nib. The capacity of a plug of given dimensions is determined during manufacture by choice of fibers, amount and kind of binder, density of plug, and other factors. Capacity may be measured by submerging the plug in the liquid for a time sufficient to acquire constant weight, removing surplus liquid by shaking, and then determining the weight of liquid imbibed. Satisfactory capacities for the 8 × 20 mm plug are in the range of 0.8 to 1.5 grams of water. This is sufficient to write at least 10,000 cm.

ILLUSTRATIVE EXAMPLES

EXAMPLE 1

The barrel and cap are injection molded to approximately the configuration shown in FIGS. 1 – 3, using thermoplastic polymeric compositions and including a yellow pigment in the barrel and a white pigment in the cap. The barrel has a maximum inside diameter of 10 mm and an overall length of 52 mm.

As the nib there is used an "ANJA" nib of bonded parallel nylon filaments. Alternative nib structures are available as "POREX" porous plastic nibs formed of hydrophilic surface treated polyolefin or fluorocarbon characterized by the manufacturer as having omnidirectional interconnecting pores, and "TRANSTIP" nylon nibs. The nib is 2 mm in diameter and 1.125 inches (28.6 mm) in length, one or both ends being bluntly pointed. The porosity of the nib is such that a small drop of water applied either midway between the ends or at either end is rapidly and substantially completely absorbed.

A total of 1000 nibs, their combined weight being 58 grams, is sealed in a waterproof plastic film envelope in contact with 31.5 grams of a dye solution and the whole allowed to stand at room temperature for 24 hours. The solution is substantially completely absorbed and the nibs achieve a uniform coloration. They are removed and distributed over a metal screen which is placed in an oven maintained at 90°–120° C. for approximately fifteen minutes until thoroughly dried.

The dye solution contains 20.0 grams of FD&C yellow No. 5 and 0.5 gram of sodium lauryl sulfate (food grade), in 79.5 grams of water. FD&C yellow No. 5 is identified by the supplier as the trisodium salt of 3-carboxy-5-hydroxyl-1-p-sulfophenyl-azopyrazole.

A treated nib is supported with the tip in a suitable holder and forced into the axial opening in the constricted end of the tubular barrel, leaving about 3.5 mm of the tip exposed.

A porous plug of bonded cellulose acetate filaments ("TRANSORB" filler), having a nominal diameter of 8 mm and length of 20 mm, is submerged in water until saturated, and free surface water is removed by gentle shaking. The dimensions of the plug remain substantially unchanged. The amount of water absorbed is approximately one gram. The plug is placed in the open end of the pen barrel and forced over the inwardly extending portion of the nib by pressing the cap against the plug and into the end of the barrel. The pen is allowed to stand for at least about five minutes, after which time it is found to produce a bright uniform yellow ink line when the tip is drawn across a white paper or other receptive surface.

EXAMPLE 2

The structure and procedure are similar to those of Example 1 except that the barrel has a pink coloration and the nibs are treated with 31.5 grams of a solution of ten grams of FD&C Red No. 3 and one gram of sodium dioctyl sulfosuccinate in 89 grams of water. Solution is achieved by heating to 80° C. The impregnated nibs are dried at 90°–100° C. The nibs are then treated with 31.5 grams of a 2% by weight solution of sodium chloride and redried at 90°–100° C. A pink marking is produced.

EXAMPLE 3

The barrel is constructed to have a green coloration. The impregnating solution contains 7.6 grams of FD&C Blue No. 1, 12.8 grams of FD&C Yellow No. 5, and 0.5 gram of sodium lauryl sulfate in 79.1 grams of water; 32 grams of the warm solution are supplied to 58 grams of the nibs. The FD&C Blue No. 1 is identified by the supplier as the disodium salt of (ethyl-(4-(p-(ethyl-(m-sulfobenzyl-)amino)-alpha-(o-sulfophenyl-) benzyliden-) 2,5-cyclohexadien-1-ylidene-)(m-sulfobenzyl-) ammonium inner salt. The activated pen produces a green marking.

In the foregoing Examples it may be shown that the amount of dye provided in each nib is between about 3 and about 6 mgm.

Marking pens as described are particularly suitable for use by children, for example in the coloring and decorating of Easter eggs. Prior to activation the pens are completely stable and may therefore be stored for long periods of time without deterioration. The activation process is neither complicated nor messy, and is intriguing to the child. The components are both harmless and inexpensive, permitting the young artist to safely employ a variety of colors and to discard the pens after use.

What is claimed is as follows:

1. A marking pen assembly comprising: a tubular barrel having an open end and a constricted end; a relatively rigid porous nib projecting from and held by said constricted end and extending into the elongated tubular body of the barrel, and impregnated with soluble coloring matter; a cap removably tightly fitting said open end; and a solvent-absorptive, porous, dimensionally stable plug dimensioned and constructed to fit loosely within said body and snugly about the extended nib when forced into said body.

2. Assembly of claim 1 wherein the cap fits within the open end of the tubular barrel and extends into said body toward said nib and, during activation of the pen, is adapted to be used to force the porous plug into said body.

3. Assembly of claim 1 wherein said coloring matter is water-soluble food coloring and said plug is water-absorptive.

4. Assembly of claim 2 wherein said nib extends substantially through said plug and said cap is dimensioned to fit over the constricted end of the barrel and the projecting tip of said nib for making possible a tandem assembly of said pens.

5. Assembly of claim 1 wherein said plug is saturated with a solvent for said coloring matter and is positioned within said body and intimately about said nib, with said cap inserted in said open end and against said plug.

6. Assembly of claim 5 wherein said coloring matter is water-soluble food coloring and said solvent is water.

* * * * *